US005182516A

United States Patent [19]

Ward et al.

[11] Patent Number: 5,182,516

[45] Date of Patent: Jan. 26, 1993

[54] MOLING SYSTEM INCLUDING TRANSMITTER-CARRYING MOLE FOR DETECTING AND DISPLAYING THE ROLL ANGLE OF THE MOLE

[75] Inventors: Peter Ward, Eastfield Dale; Stephen J. Glen, Boldon Colliery, both of United Kingdom

[73] Assignee: British Gas plc, United Kingdom

[21] Appl. No.: 640,292

[22] PCT Filed: Jun. 8, 1990

[86] PCT No.: PCT/GB90/00892

§ 371 Date: Jan. 23, 1991

§ 102(e) Date: Jan. 23, 1991

[87] PCT Pub. No.: WO90/15221

PCT Pub. Date: Dec. 13, 1990

[30] Foreign Application Priority Data

Jun. 9, 1989 [GB] United Kingdom ..... 8913319

[51] Int. Cl.[5] ..... G01V 3/165; E21B 7/04

[52] U.S. Cl. ..... 324/326; 175/45

[58] Field of Search ..... 324/326; 175/19, 45; 166/250

[56] References Cited

U.S. PATENT DOCUMENTS 3,746,106 7/1973 McCullough et al. .
4,621,698 11/1986 Pittard et al. .

FOREIGN PATENT DOCUMENTS 0262882 9/1987 European Pat. Off. .
0361805 9/1989 European Pat. Off. .
WO9000259 6/1989 PCT Int'l Appl. .
2038585 12/1978 United Kingdom .
2175096A 5/1986 United Kingdom .
2197078 10/1986 United Kingdom .
2220070A 4/1989 United Kingdom .

*Primary Examiner*—Walter E. Snow
*Attorney, Agent, or Firm*—Larson & Taylor

[57] ABSTRACT

A moling system comprises a mole (10) having a head (26) with a slant face at the leading end of a string of hollow rods (20). The rods are rotatable by a rig (12). The mole is an impact mole fed by air passed through the rods. While the mole rotates it travels approximately straight, but nonrotating it travels according to the direction of the slant face (28). The mole contains a radio sonde having one coil lying lengthwise and one transverse to the lengthwise direction of the mole. A receiver (22) is traversed across the ground to locate the radio sonde and display roll angle. The mole is stopped from rotating at the correct position when steering is required and powered without rotating to change course. An impact activated switch in the mole switches off the battery supply while the impact mechanism is activated.

13 Claims, 17 Drawing Sheets

FIG. 8. A
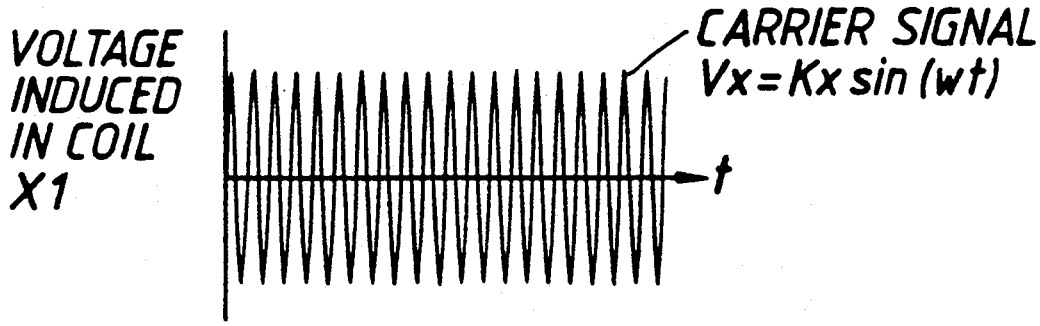
FIG. 8. B
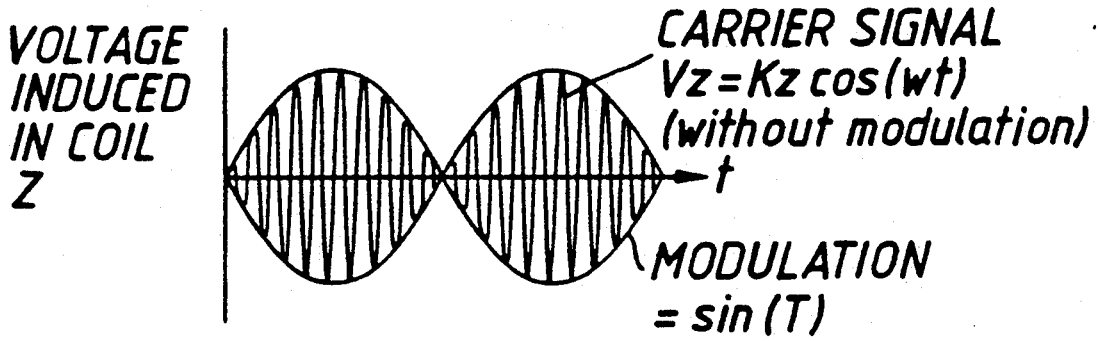
FIG. 8. C
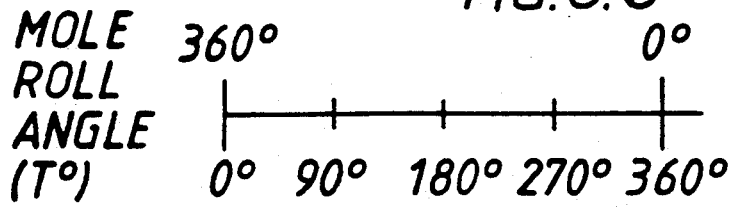

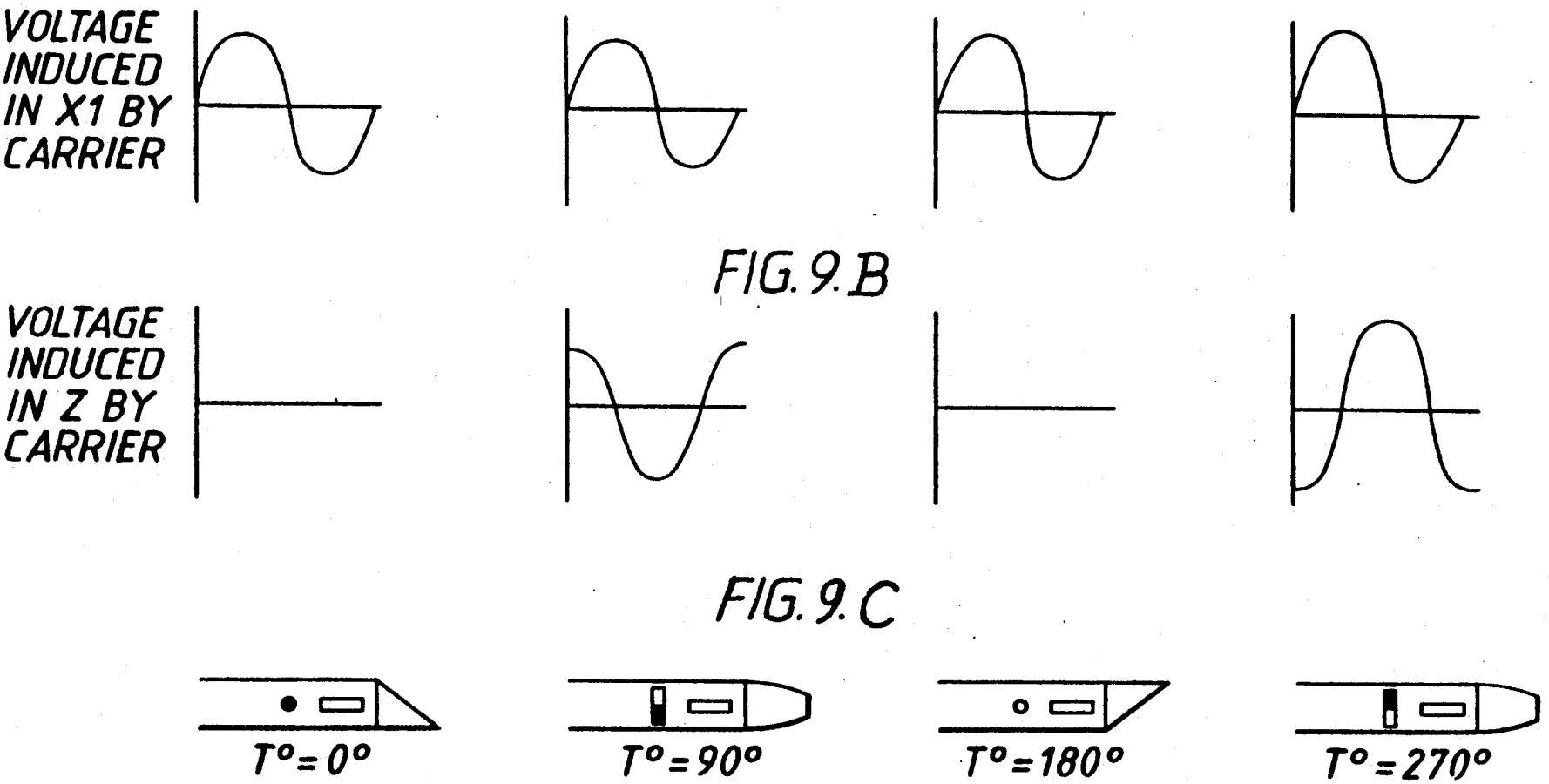
FIG. 9.A
FIG. 9.B
FIG. 9.C

FIG. 11. A
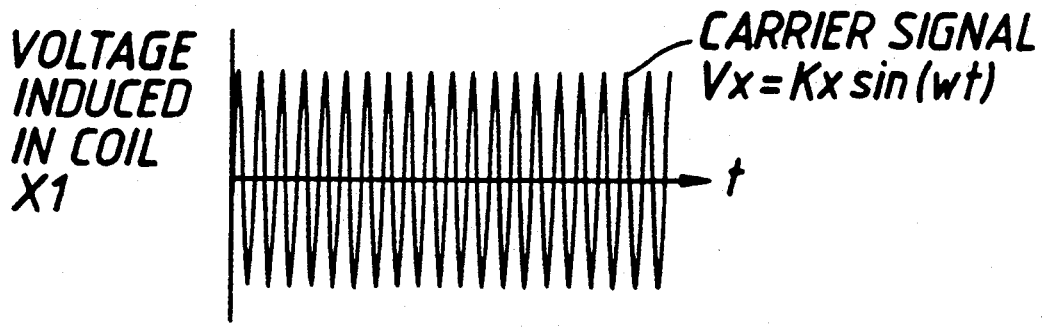
FIG. 11. B
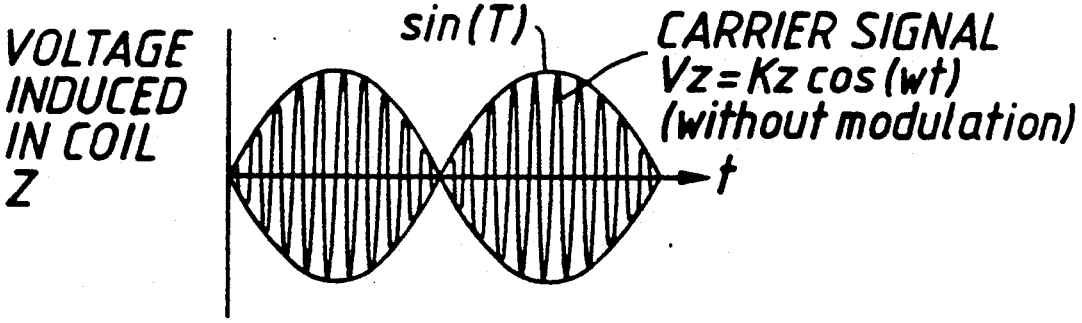
FIG. 11. C
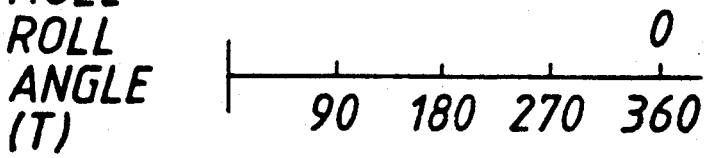
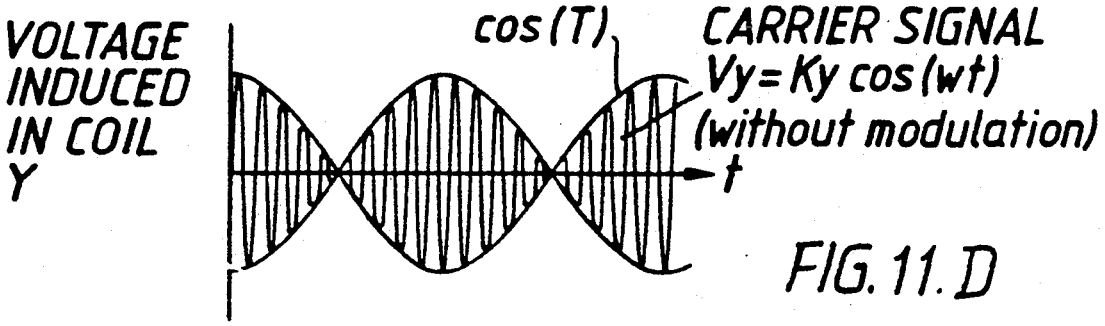
FIG. 11. D FIG. 12.
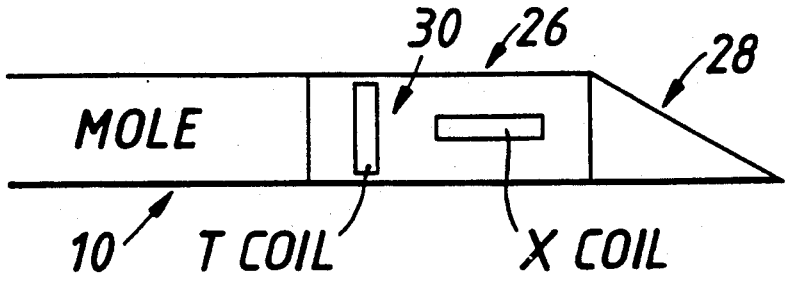
FIG. 13.
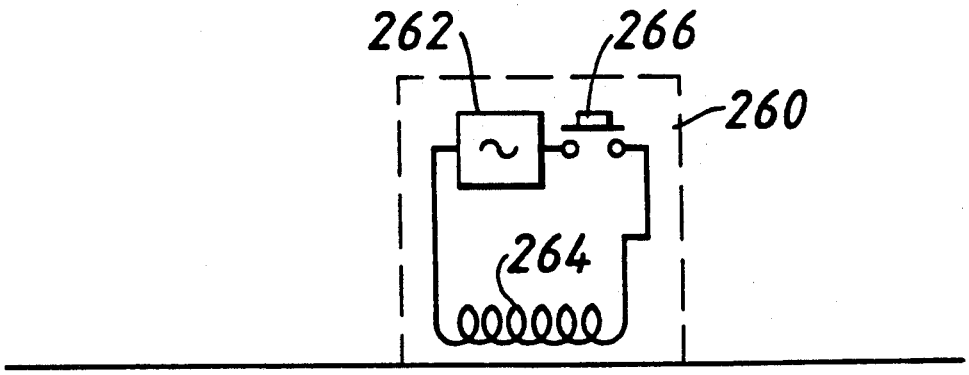
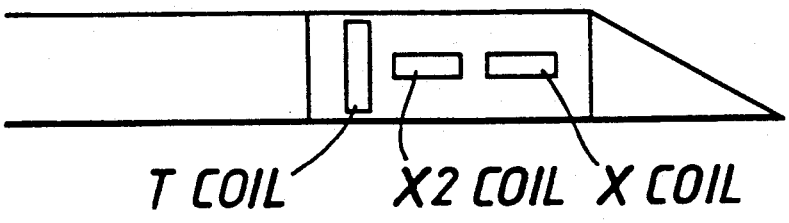

MOLING SYSTEM INCLUDING TRANSMITTER-CARRYING MOLE FOR DETECTING AND DISPLAYING THE ROLL ANGLE OF THE MOLE

The invention relates to moling systems, particularly though not exclusively systems applicable to the installation of gas pipes or other services in the ground.

The moling system to which this invention relates is one in which the angular position of the mole about its longitudinal axis is required to be known.

Such angular position of the mole is referred to the "roll angle". The mole is, for example, a percussive mole attached to the leading end of a series of hollow, drill rods through which air is supplied to the percussive mechanism of the mole. The mole has a head at its leading end incorporating a slant face. The mole head receives a transverse steering force at its slant face as it is advanced. To bore approximately in a straight line the drill rods and the mole are rotated at approximately 20 revolutions per minute so that the mole pursues a corkscrew path. To steer, rotation is stopped to leave the slant face in the required orientation. Air continues to be fed to the mole which advances along the curved path dictated by the steering force experienced by the slant face.

The object of the invention is to provide a moling system in which the roll angle of the mole is determined using a radio sonde located in the mole.

According to the invention, a moling system which is capable of giving an indication of mole location and depth comprises a rotatable mole, a radio sonde in the mole having a first transmit coil lying parallel to the lengthwise direction of the mole and a second transmit coil lying transverse to said direction, means including a battery and an oscillator for energising the transmit coils with alternating current with a phase difference between the coils and a receiver traversable above ground into a position in which it can give an indication of roll angle.

In one form of system the radio sonde has a first transmit coil lying parallel to the lengthwise direction of the mole and a second transmit coil lying transverse to said direction, the coils being energised by a single frequency, the energising voltages to the two coils having a phase difference between them and the radiated field from the coils being used for location and measurement of roll angle and depth.

In another form of system the radio sonde has a first transmit coil lying parallel to the lengthwise direction of the mole and a second transmit coil lying transverse to said direction, the coils are energised by a single frequency, the energising voltages to the two coils having a phase difference between them and the radiated field from the coils being used for roll angle measurement only, and the coil lying parallel to the lengthwise direction of the mole being additionally energised with a second frequency and the resulting radiated field being used for location and depth measurement.

In another form of system the radio sonde has a first and a second transmit coil lying parallel to the lengthwise direction of the mole and a third transmit coil lying transverse to said direction, the first transmit coil being energised by a first frequency and the resulting radiated field being used for location and depth measurement, and the second and third transmit coils being energised by a second frequency, the energising voltages to the two coils having a phase difference between them and the resultant radiated field being used for roll angle measurement only.

In one form cf system, the receiver comprises a horizontal phase-reference receive coil and one other receive coil transverse to said phase-reference coil, which receiver is traversable above ground until said phase-reference receive coil is directly above the sonde and parallel to said first transmit coil, the receiver further comprising first means for measuring the variations of the amplitude of the signal from said other receive coil as the mole rotates, a second means for displaying the amplitude variations as an indication of roll angle, and a third means for detecting the phase reversal which occurs in the signal from the transverse receive coil as the mole rotates.

In another form of system, the receiver comprises a horizontal phase-reference receive coil and two roll-angle receive coils transverse to each other and to said horizontal phase-reference receive coil, which receiver is traversable above ground until said and parallel phase-reference receive coil is directly above the sonde a digital display on which roll-angle is displayed, a resolver/converter which receives outputs from all three coils, a fourth means for combining the output from the two roll angle receive coils, a fifth means for demodulating the combined signal using the signal from the horizontal phase-reference coil as a reference signal, and a sixth means of converting the demodulated dignal into a digital signal for transfer to the display.

The invention will now be described by way of example with reference to the accompanying drawing, in which:

FIGS. 8A to 8C and 9A to 9C are diagrams showing signals received by the three-coil receiver and of phase-reversal of the carrier in the Z coil of the three-coil receiver;

FIGS. 11A to 11D are diagrams of signals received by the four-coil receiver;

FIGS. 12 and 13 show modified radio sondes in the head of the mole; and

Figure 1:
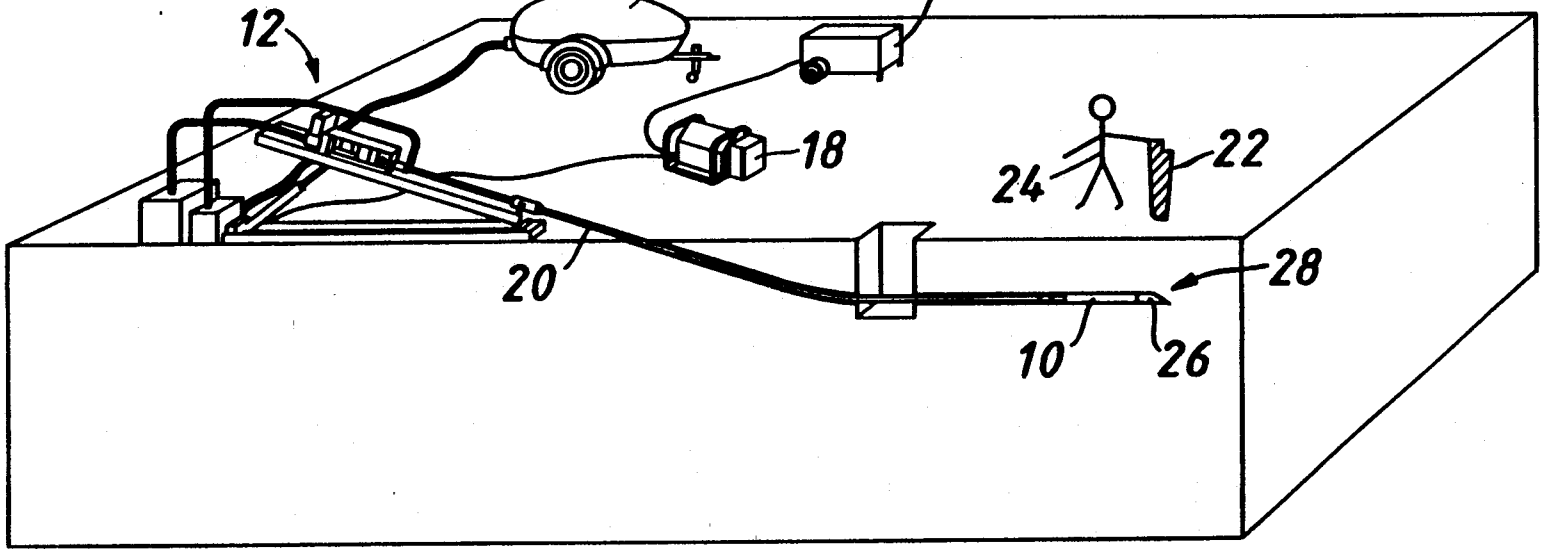
FIG. 1 is a schematic drawing showing moling in progress.

The moling method is described by way of example with reference to FIG. 1 in which a mole 10 is shown being used to bore a pilot bore through which, when completed, an expander can be pulled to enlarge the bore. Then a gas pipe can be pulled into the expanded bore, or simultaneously pulled into the bore. Alternatively, a percussive mole is led through the pilot bore to expand it to the required size. Of course the method is not limited to the installation of gas pipes. For example, it may be applied to water and sewage pipes or the installation of electric cables or other services. FIG. 1 also shows the following main components; a launch rig 12 from which boring is commenced; an air compressor 14; a power pack 16; a control table 18; drill rods 20 connected to the trailing-end of the mole 10; and a receiver 22 under the control of an operative 24.

The drill rods 20 are, for example, 1.5 meters long and are rotated at 20 revolutions per minute by a hydraulic motor at the launch rig 12, though that speed is not critical and, for example may be in the range 5–100 revolutions per minute. The rods 20 are added one by one as the mole 10 progresses. Compressed air is fed through the rods 20 to the impulsive mechanism of the mole 10. The mole 10 is, for example, 45 millimeters in diameter with a 50 mm toughened steel head 26 made from bar stock. The head 26 has a slant face 28 and so long as the rods 20 and mole 10 are rotated the mole advances in a corkscrew path approximating to a straight line. However, when rotation is stopped the mole 10 follows a curved path according to the angular position of the head 26 because of the soil reaction on the slant face 28.

Figure 2:
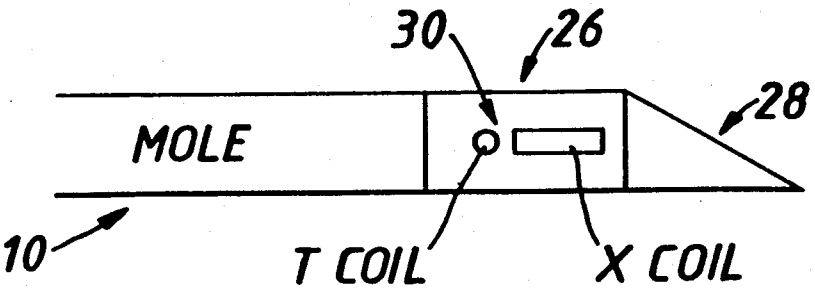
FIG. 2 is a detail of the mole head.

As the mole progresses its location, depth and roll angle are determined using a radio sonde in the mole and a receiver 22 at the surface of the ground. The radio sonde is indicated in FIG. 2 at 30. The sonde comprises an X coil arranged to lie in the lengthwise direction of the mole and a T coil arranged to lie across that direction and horizontally when the slant face 28 faces upwards. The head 26 has a transverse, rectangular recess in the form of a slot (not shown) 70 mm long, 18 mm wide and 40 mm deep. The ends of the slot are lined with rubber compound to isolate the sonde 30 from the shock forces which arise when the mole 10 is driven by the impulsive mechanism. The sonde 30 is rectangular in external shape being 65 mm long, 15 mm wide and 40 mm deep. The sonde 30 is powered by direct current and batteries and electronics (not shown in FIG. 2 but see FIG. 3) are fully encapsulated to reduce the effects of vibration.

The batteries are rechargeable and have soldered terminals to avoid the problem of contact bounce encountered with dry cells. A diode is incorporated in the sonde package between the battery and the external terminals to prevent accidental discharge should the terminals be short circuited (for example by the ingress of water). The batteries have a continuous operating time of approximately 4 hours.

The diagram in FIG. 2 merely shows the coils X and T. In practice, they are each wound on a respective ferrite rod 4 mm in diameter. They are energised by an alternating current of 8 kilo-herz, and there is a phase difference of 90° between the energising voltage to each coil. The inductance of the two coils is chosen such that, at that frequency, the current through each has a triangular waveform. The effect of this is to produce a magnetic field which rotates at 8 kHz in the plane of the two coils. If the waveform were sinusoidal, the magnetic rotating vector would describe a circle but the triangular excitation of the coils results in an eliptically rotating vector. The orientation of the X and T coils was deliberately chosen so that the magnetic vector rotates in the plane of the slot in the head of the mole rather than across the plane of the slot. This has the advantage that distortion of phase and amplitude information by the magnetically soft steel in the head is kept to a minimum.

Figure 3:
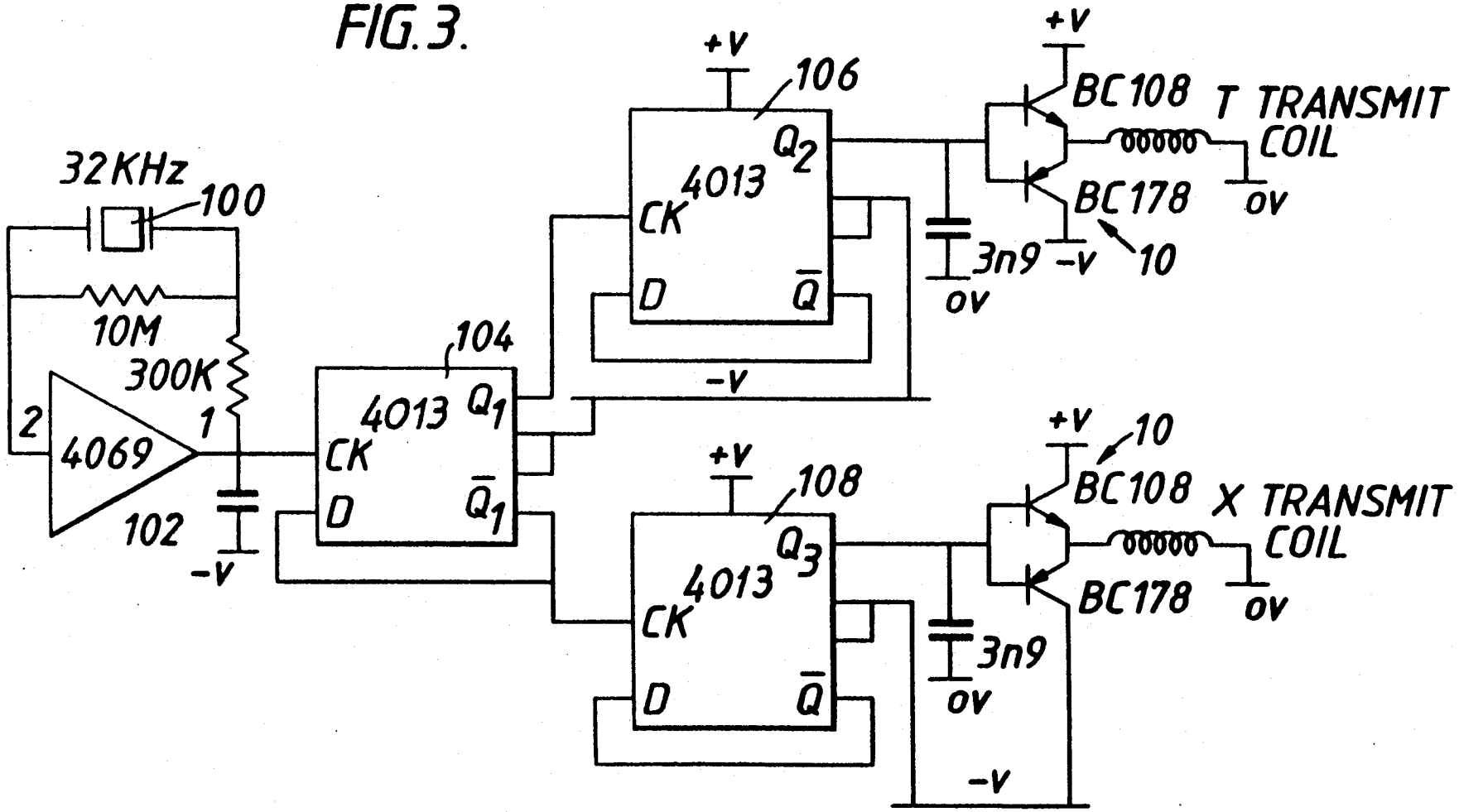
FIG. 3 is a circuit diagram of the radio sonde used in the mole.

The coils are energised from an oscillator which provides two square wave outputs 90° out of phase, the T coil leading. FIG. 3 shows the transmitter circuit diagram. A 32.768 kHz crystal 100 is used with a Schmitt Inverter 102 to generate a 32.768 kHz square wave signal. The signal is divided using a "D"-type flipflop 104 to give two 16.384 kHZ outputs at Q1 and $\overline{Q\text{-}1}$. These are then divided using two further "D" types 106, 108 to 8.192 kHz. As the "D" types are positive edge triggered, then the resulting outputs Q2 and Q3 are 90° out of phase. Q2 and Q3 are used to drive the two coils T and X via a push-pull arrangement of transistors 110.

Figure 4:
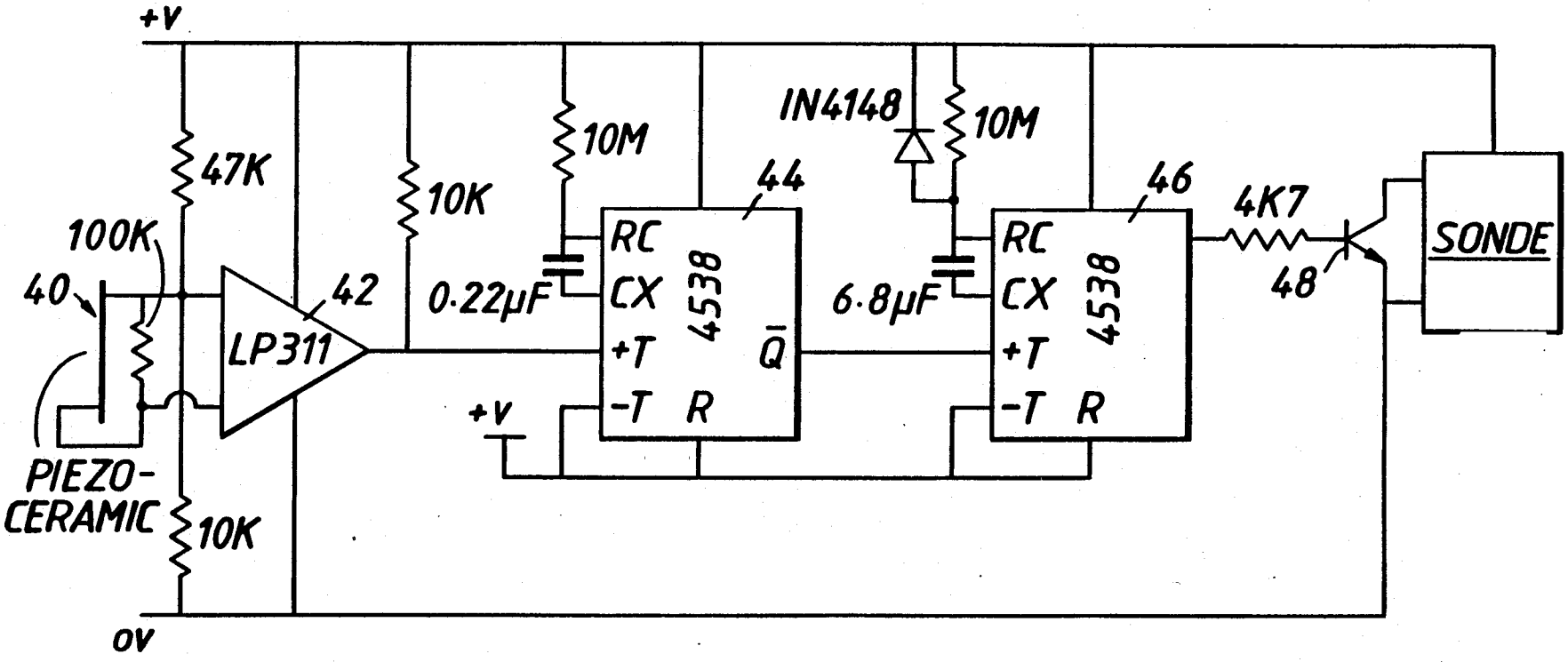
FIG. 4 is a circuit diagram of an impact activated switch used to control, the energisation of the sonde in the head.

The effective life of the batteries is extended using an impact-activated switch circuit, FIG. 4 which, when the sonde has to be left overnight in the mole, in the ground, switches off the oscillator circuit. In this way, the effective life of the batteries is extended to 36 hours or more.

In particular, the sonde is only switched on every time a drill rod is added to the string. When the mole is running impacts are sensed in the head and the transmitter circuit is deactivated. However, when the mole stops, the impacts cease and the transmitter circuit is activated for 2 minutes before automatically switching off. It is during the 2 minute active period, that mole location and roll angle measurement are carried out.

The impact switch circuit has a standby current drain of 0.5 milli-ampere and for a 100 meter moling run that gives a period of 3 days between battery charges.

A small piezo-electric ceramic sensor 40 is used to detect impacts. The output from the senso 40 is in the form of voltage spikes which are converted to logic level pulses using a comparator 42. These are present while the mole is running and are used to trigger a re-triggerable monostable 44. The pulses occur every 0.2 seconds and the time constant of the monostable is set to 2 seconds so that if a pulse does not occur within 2 seconds then the monostable will time out. One output of the monostable is therefore held low during impacting. The same output is connected to the trigger input of a second monostable 46 which has a time constant of 2 minutes. When the mole stops impacting, the trigger input goes from logic 0 to logic 1, thus triggering the second monostable 46. The output of this monostable 46 is used to switch the power to the sonde 30 transmitting circuit via a transistor 48.

In order to achieve the required steering accuracy it is preferable to measure:

(a) the plan position of the mole and the depth to an accuracy better than 50 mm over a range of 0.3 m to 1.5 m (b) the roll angle T to an accuracy of better than plus or minus 10° over a range of 360° with no ambiguities.

Figure 5A:
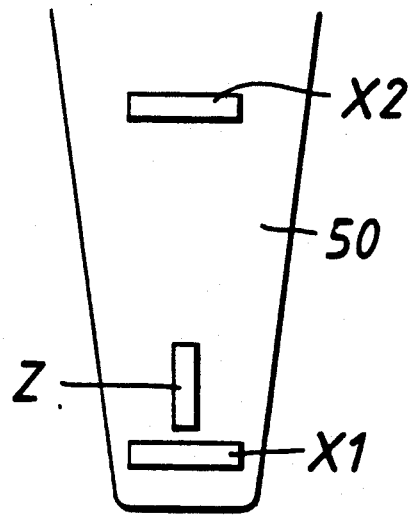
FIG. 5A and 5B are vertical elevations through a three-coil and a four coil receiver.
Figure 5B:
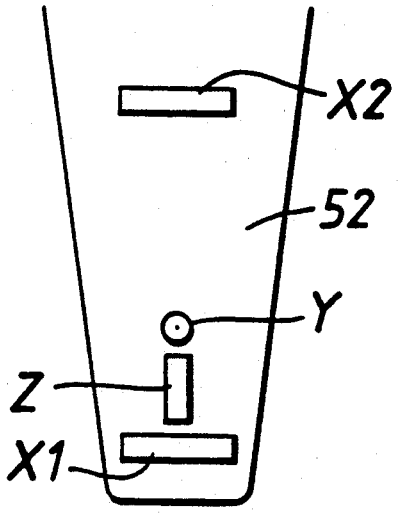

The necessary measurements are carried out using a receiver which receives the signal transmitted by the sonde in the head of the mole 10. The receiver may be a three coil receiver 50 shown in FIG. 5A or a four coil receiver 52 shown in FIG. 5B.

Figure 6:
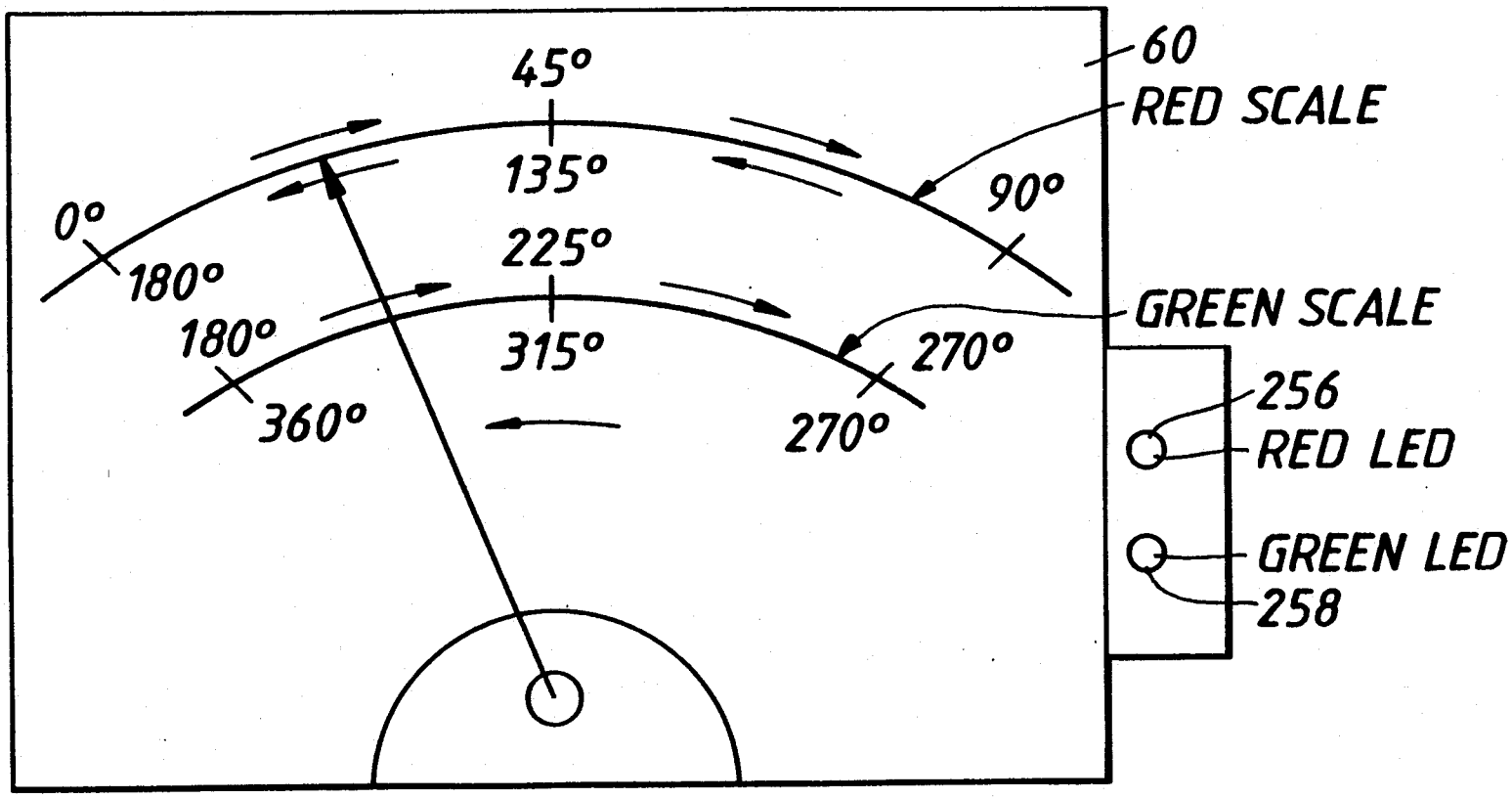
FIG. 6 is a view of an analogue display used in the three-coil receiver.
Figure 7A:
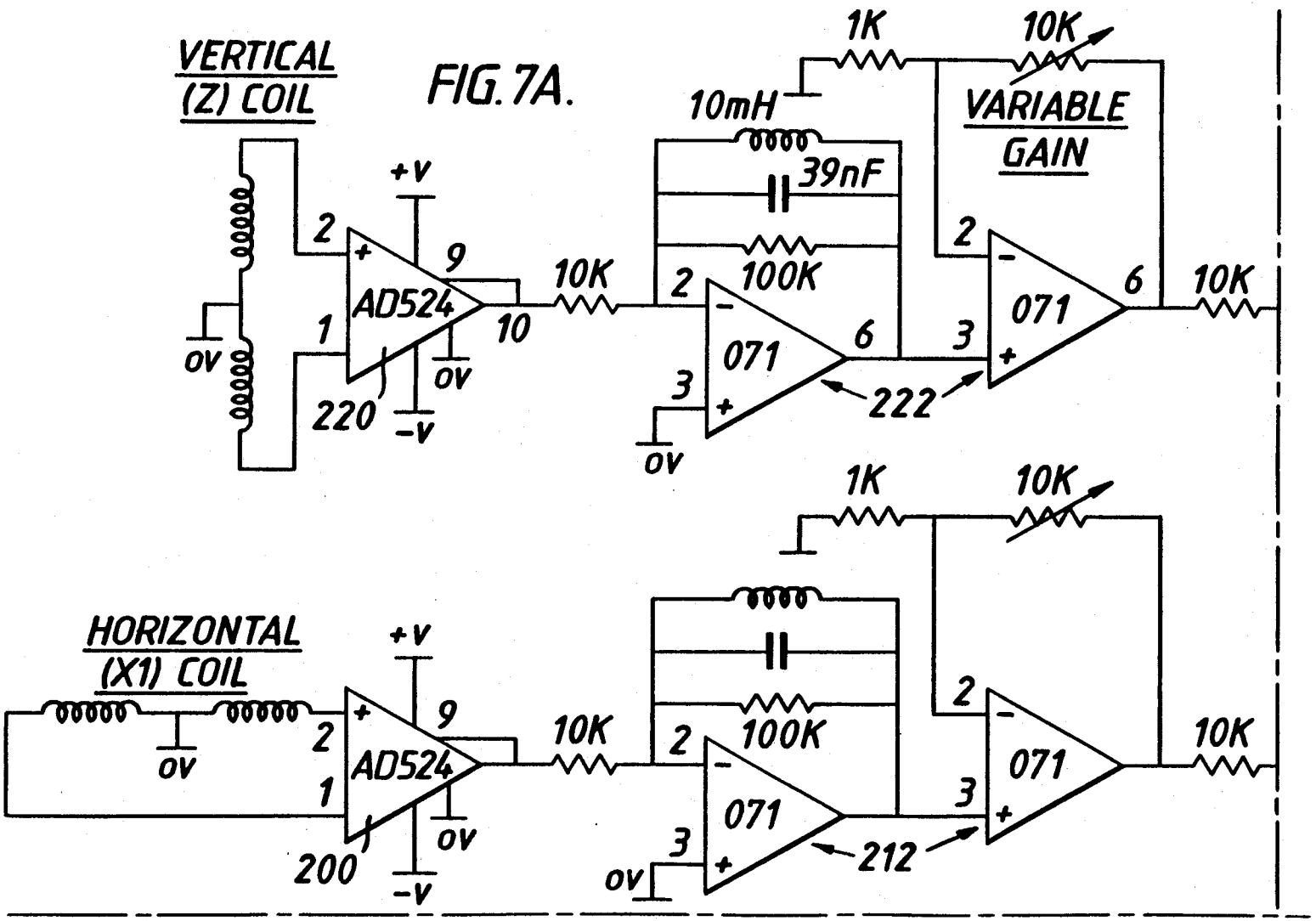
FIG. 7A to 7D is a circuit diagram of the three-coil receiver.
Figure 7B:
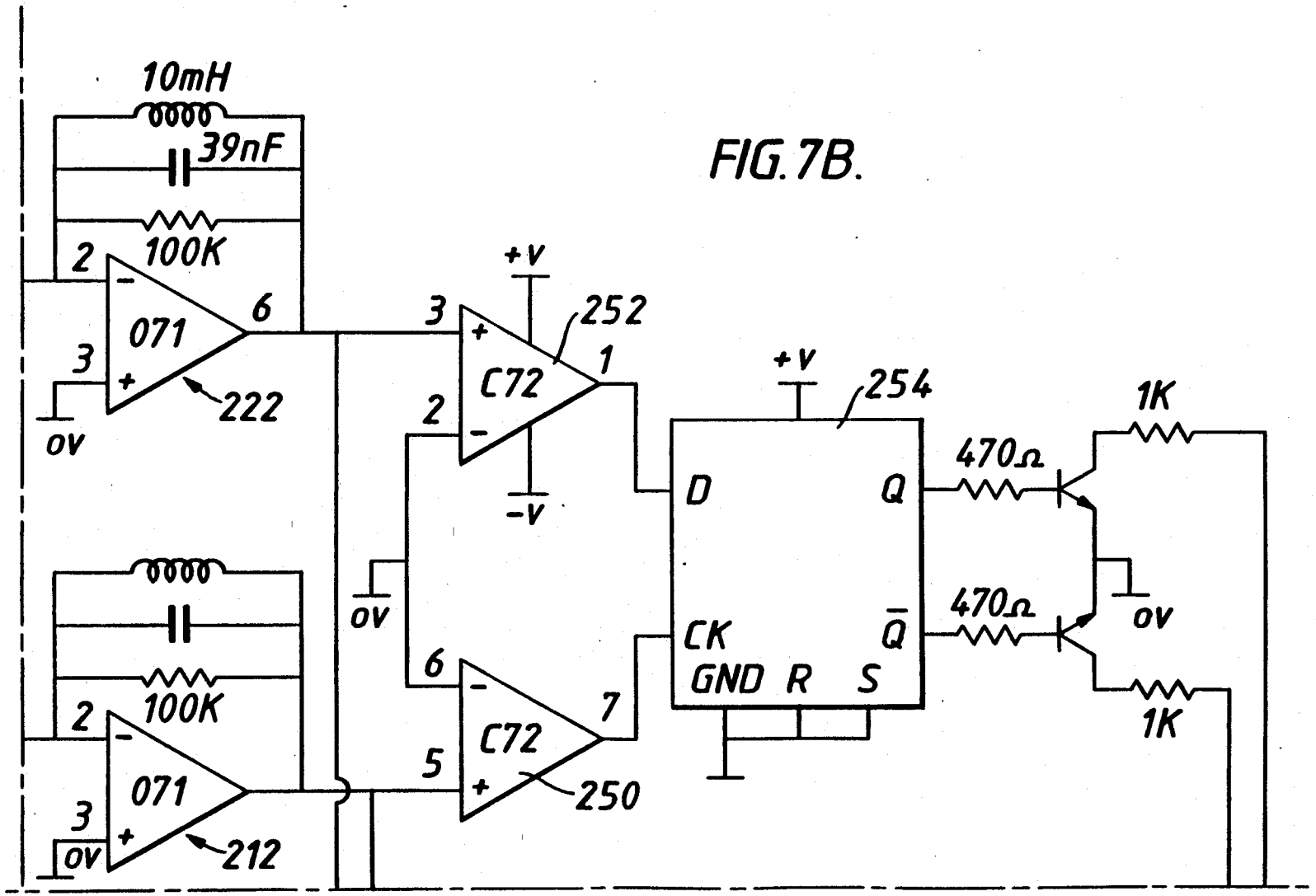
Figure 7C:
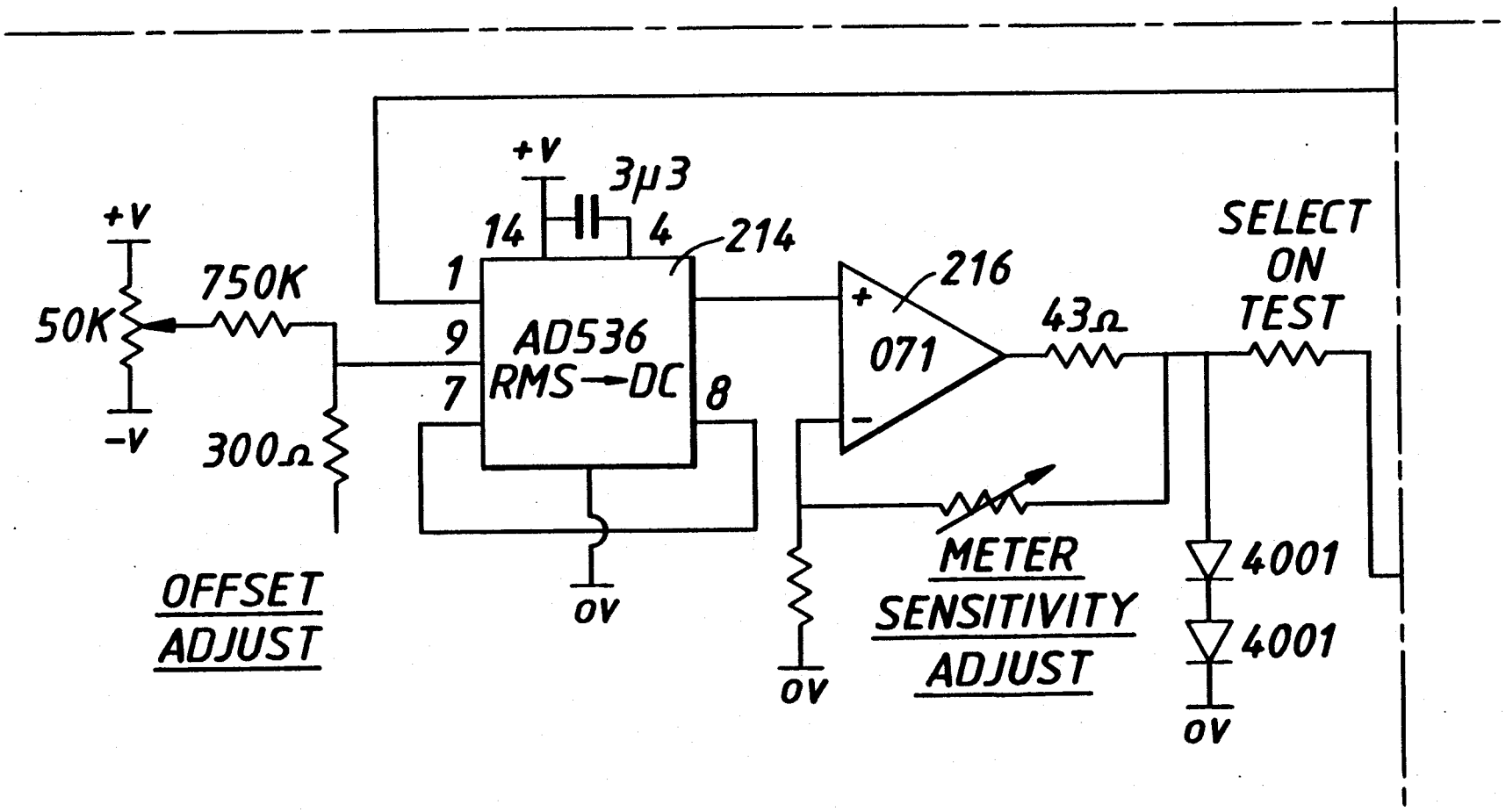
Figure 7D:
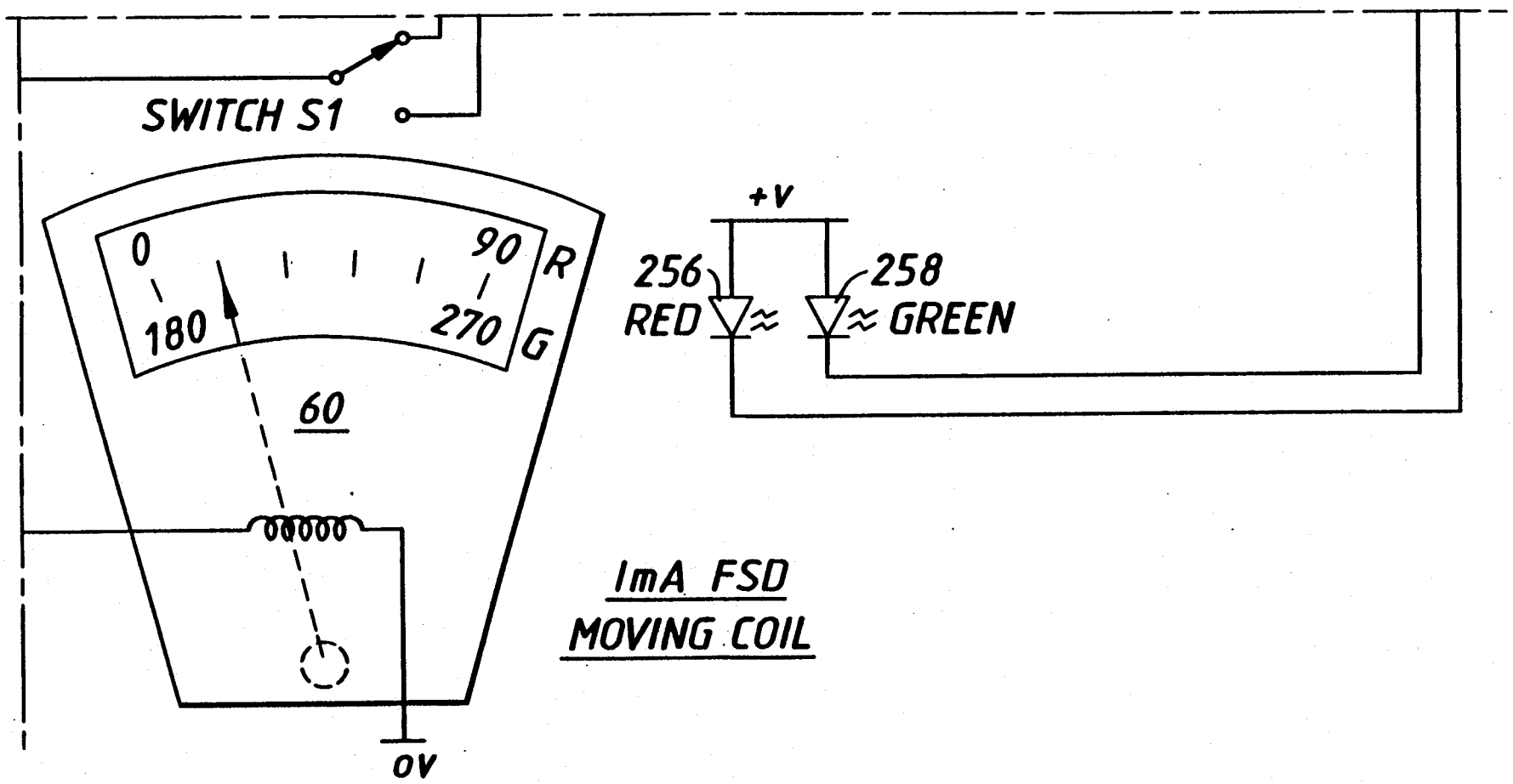

We will first describe the operation of the three-coil receiver 50. It comprises two horizontal coils X1 and X2, Xl being a horizontal phase-reference receive coil, and a vertical receive coil Z. FIG. 6 shows the circuit diagram for coils Xl and Z for simplicity. The X2 coil is used for depth measurement which need not be described here.

Location is measured first. The receiver is scanned across the surface of the ground with the Xl coil aligned with the known longitudinal direction of the mole and the output of X1 is observed at the analogue display. The signal from X1 is buffered and amplified using an AD 524 instrumentation amplifier 200. The signal is then filtered and amplified using a two-stage tuned amplifier 212. The signal from amplifier 212 is passed via switch S1 to an AD 536 root-mean-square to direct current converter 214. The dc signal is amplified by an amplifier 216 and passed to the moving coil meter 60 forming an analogue display. The amplitude of movement is dependent on the distance of the sonde from the receiver. The maximum amplitude is obtained when the X1 coil is positioned vertically above the sonde.

Once the receiver has been positioned vertically above the sonde then the depth can be measured by mesuring the outputs from the X1 and X2 coils and electronically calculating the gradient of the magnetic field between the two. Since the field gradient is a function of distance from the source, then an estimate of distance from the sonde to the detector (i.e. depth) can be made.

For roll angle determination the switch S1 is turned to the appropriate position and the signal from the Z coil is displayed on the analogue display.

The signal from the Z coil is handled in the same way as that from the X1 coil using an AD 524 instrumentation amplifier 220, a two-stage, tuned amplifer 222, a root mean square to direct current converter 214, an amplifier 216, and the moving coil meter 60.

The shape of the field radiated by the sonde is designed so that as the mole rotates, the component of the field detected by coil X1 maintains a constant direction and peak amplitude while the amplitude of the component detected by the Z coil varies as a sine function over each 360° of roll motion of the mole.

In fact X1 responds only to the field radiated by the X coil in the sonde, which has a form sin wt where w=2[pi]f and f is the carrier frequency of 8 kHz. The voltage VX induced in X1 is of the form VX=KX sin wt where KX is a tranfer constant. In a similar fashion the directionality of the Z coil is such that it responds only to the field radiated by the T coil in the sonde which has a form cos wt. The voltage VZ induced into the Z coil is of the form VZ=KZ sin R cos wt, where R is the angle of roll motion of the mole relative to a reference zero degree position.

Roll angle is measured by demodulating the signal from the Z coil and displaying the resultant sin R signal on the moving coil meter 60. As the mole rotates, the operator adjusts the gain control so that the meter needle sweeps from zero to full scale. Unfortunately, the process of demodulation removes the quadrant information from the signal and the meter would therefore display ambiguous information over the range 0°-180° and 180°-360°. In order to resolve this ambiguity the carrier signals from the X1 coil are passed to a phase detector circuit which detects the phase reversal when the T coil of the sonde passes through 90° and 270° to the horizontal. At each phase reversal the circuit illuminates a green LED or a red LED adjacent two similarly coloured scales, one marked 0°-90°-180° and the other 180°-270°-360°. Over the range 0°-360° the needle sweeps from zero to full scale and back to zero twice. The operator must therefore select the appropriate scale and then note the direction of travel of the needle to measure the correct angle e.g. on the 0°-180° scale if the needle is travelling left to right the scale reading is 0°-90° while if the needle is travelling right to left the scale reads 90°-180°.

Since the signals from the X coil and the T coil are 90° out of phase, the signals detected by the X1 and Z coils will also be out of phase by 90° but over the range 0° to 180° the phase of X1 will lead Z by 90° while over the range 180° to 360° the phase of X1 will be Z.

The signals from the X1 and Z coil amplifiers are fed to open-loop gain amplifiers 250,252 which convert the signals to square waves. These are fed to the clock and data inputs of a 4031 "D" type flipflop 254. On the rising edge of each clock pulse, derived from the X1 coil signal, the logic level on the "D" input, derived from the Z coil signal, is transferred to the "Q" output. Thus, when the signal applied to "D" leads the clock, a logic 1 appears at the "Q" output. When the signal applied to "D" lags the clock, a logic 0 appears at "Q". The outputs "Q" and "$\overline{Q}$" are used to illuminate the two LED's 256,258.

FIG. 8A shows the carrier voltage induced in the X1 coil, which has the form VX=KX sin wt referred to above, where w=(2 pi)(8 kHz). This remains constant as the mole undergoes roll action. It also remains constant over small angles of pitch and yaw. At FIG. 8B is shown the voltage induced in the Z coil, which has the form VZ=KZ Sin R cos wt where R is the roll angle of the mole relative to a reference zero degree position. The carrier signal is modulated as the mole undergoes roll action, as indicated at FIG. 8C.

FIGS. 9A and 9B show one cycle of the carrier signal, detected by the X1 and Z coil respectively, with the roll angle, as indicated in FIG. 9C at 0°, 90°, 180° and 270° respectively. This shows that a phase reversal occurs in the carrier signal detected by the Z coil when the coil T passes through the 90° and 270° values of roll angle.

Figure 10:
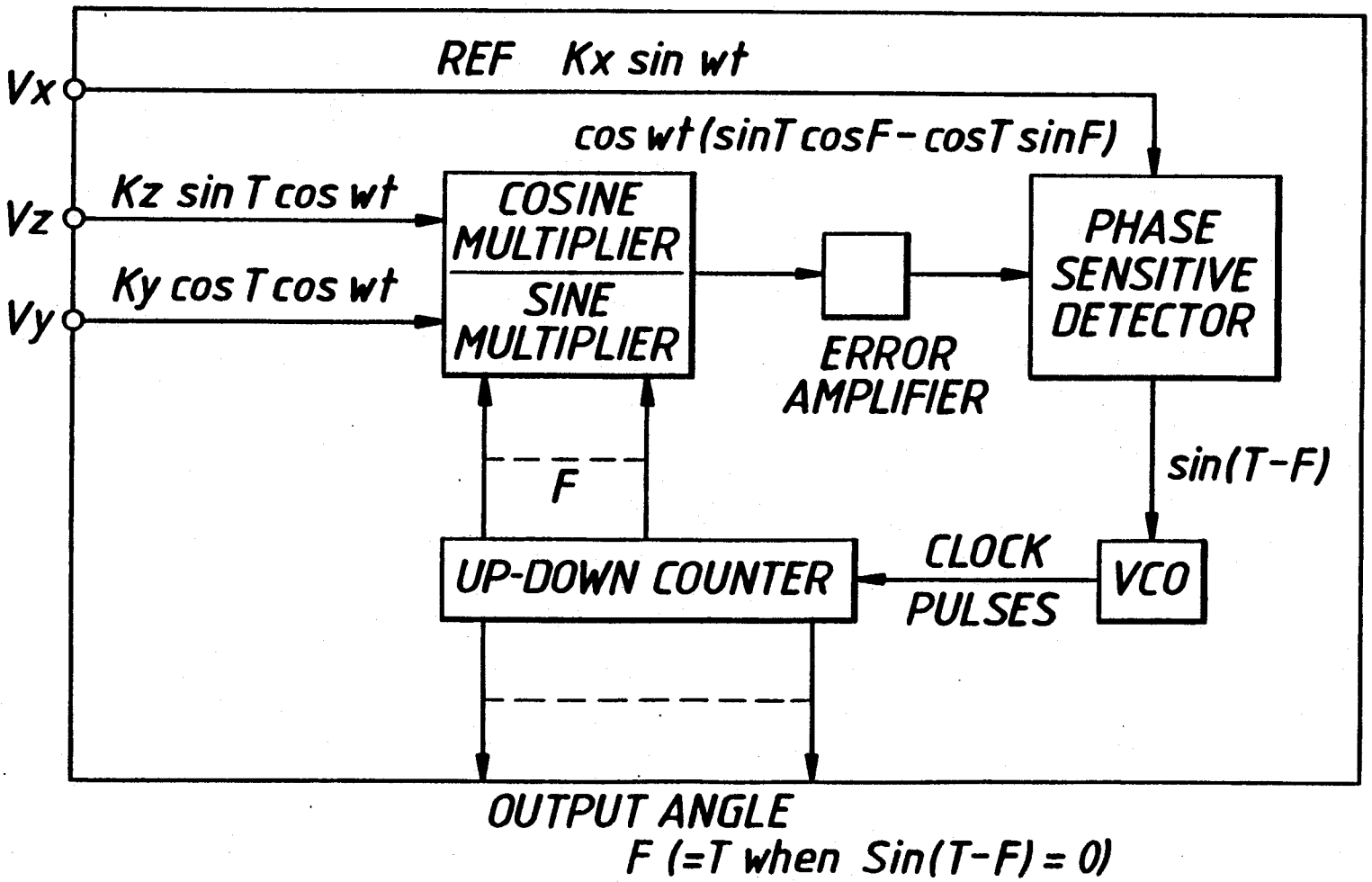
FIG. 10 is a block diagram of the resolver to digital tracking convertor used in the four-coil receiver.

A block diagram of the resolver to digital tracking converter used in the four-coil receiver is shown in FIG. 10. The components of the four-coil receiver connected to the left-hand side of the block diagram shown in FIG. 10 are similar to the circuit shown in FIG. 7 to the left of item 254. When the four-coil receiver is used, it is scanned across the surface of the ground to locate the mole vertically above the sonde and with the XI coil aligned with the longitudinal direction of the mole as before. The receiver (FIG. 5B) has an extra receive coil, the Y coil, transverse to the Z coil and to the X1 and X2 coils. With the X1 coil aligned parallel to the lengthwise direction of the mole, the X1 and Z coils detect the field radiated from the sonde as described for the three-coil receiver. The Z and Y coils are roll angle receive coils.

The voltage induced into the X1 coil has the form VX=KX sin wt and the voltage induced into the Z coil has the form VZ=KZ sin R coswt. Since the Z and Y coils are perpendicular to each other and in the plane of rotation of the T transmitter coil then, as the mole rolls, the peak amplitude detected by the Z coil will be 90° out of phase with the peak amplitude detected by the Y coil. Thus, the voltage induced into the Y coil will have the form VY=KYcos R coswt.

Roll angle information is converted to a digital format using the resolver-to-digital-tracking converter, type TS 81 shown in FIG. 10. This circuit accepts a reference signal VX at the carrier frequency and two data signals VZ, VY modulated with sin R or cos R. In operation, the sine and cosine multipliers are in fact multiplying digital to analogue converters, which incorporate sine and cosine functions. Begin by assuming the current state of the up down counter is a digital number representing a trial angle F. The converter seeks to adjust the digital angle to become equal to, and to track R the analogue angle being measured. The Z coil output voltage VZ=KZ sinRcoswt is applied to the cosine multiplier and multiplied by cos F to produce KZ sin R cos F coswt. The Y coil output voltage VY=KY cos R cos wt is applied to the sine multiplier and multiplied by sin F to produce KY cos R sin F coswt.

These two signals are subtracted by the error amplifier to yield an error signal in the form cos wt (sin R cos F−cos R sin F) or cos wt sin (R−F).

The phase sensitive detector demodulates this AC error signal using the X1 coil output voltage as a reference. This results in a DC error signal proportional to sin (R−F). The DC error signal drives a voltage controlled oscillator (VCO) which in turn causes the up-down counter to count in the proper direction to cause sin (R−F) to be equal to zero. At this point F R and hence the counter has a digital output which represents the roll angle R.

Since the operation of the tracking converter depends only on the ratio between the VZ and VY signal amplitudes, attentuation of these signals due to variations in the depth of the sonde does not significantly affect performance. For similar reasons, the tracking converter is not susceptible to waveform distortion and up to 10% harmonic distortion can be tolerated.

The four coil receiver has three operational advantages over the three coil receiver:

(1) the gain of the system is adjusted automatically as depth changes, so that the operator does not need to adjust the signal level from the Z coil before reading roll angle;

(2) the roll angle display is either in the form of a circular ring of LED's or a digital output. This considerably simplifies the form of the display compared with the three coil system where the operator must select one of two scales and determine the direction of travel of the needle to read roll angle;

(3) the roll angle indicator moves at constant velocity thus simplifying the process of stopping the mole with its head at the required angle.

The output of the TS 81 converter is a 12-bit pure binary output with a value proportional to roll angle. This output is decoded and used to drive either a 3-bit seven segment display or a ring of 12, 16 or 32 LED's depending on the resolution required.

FIG. 11A shows the carrier voltage induced in the X1 coil, which has the form VX=KX sin wt referred to above, where W=(2 pi)(8 kHz). This remains constant as the mole undergoes roll action. It also remains constant over small pitch and yaw angles.

At FIG. 11B is shown the voltage induced in the Z coil, which has the form VZ=KZ sin R cos wt where R is the roll angle of the mole relative to a reference zero degree position. The carrier signal is modulated as the mole undergoes roll action, as indicated at FIG. 11C.

At 11D is shown the voltage induced in the Y coil which has the form VY=KYcos Rcoswt. The carrier signal has the same phase as that detected by the Z coil but the modulation signal is 90° out of phase compared with that detected by the Z coil.

In practice, moling continues while the location and depth are repeatedly monitored every time a new rod is added to the drill string. When it is required to correct the course of the mole, the position of the slant face is stopped (by stopping rotation of the hydraulic motor) at the orientation displayed on the analogue display or on the digital display at the three-coil receiver or the four-coil receiver, depending on which is used. Moling then continues with the hydraulic motor stopped, the mole travelling in a curve. During this action, location and depth are still monitored as rods are added to the string. Ultimately, the course correction will have been completed and moling can continue with rotation as before.

The system is not limited in its application to percussive moles. For example, it can be applied to non-percussive moles; also it is not limited to moles rotated by rods attached to the rear of the mole.

FIG. 12 shows a modified mole in which the radio sonde 30 has a T coil lying vertically when the slant face 28 faces upwards, instead of the arrangement shown in FIG. 2. This orientation of the X and T coils produces a magnetic vector which rotates across the plane of the slot in the mole head. This has the advantage that, compared with other relative orientations, the attenuation of the radiated field is reduced and the distortion of the phase and amplitude information is kept to a minimum.

FIG. 13 shows a modified radio sonde in which there are two coils X and $X_2$ lying parallel to the longitudinal direction of the mole. FIG. 13 also shows a modified way to switch on the radio sonde.

Figure 14:
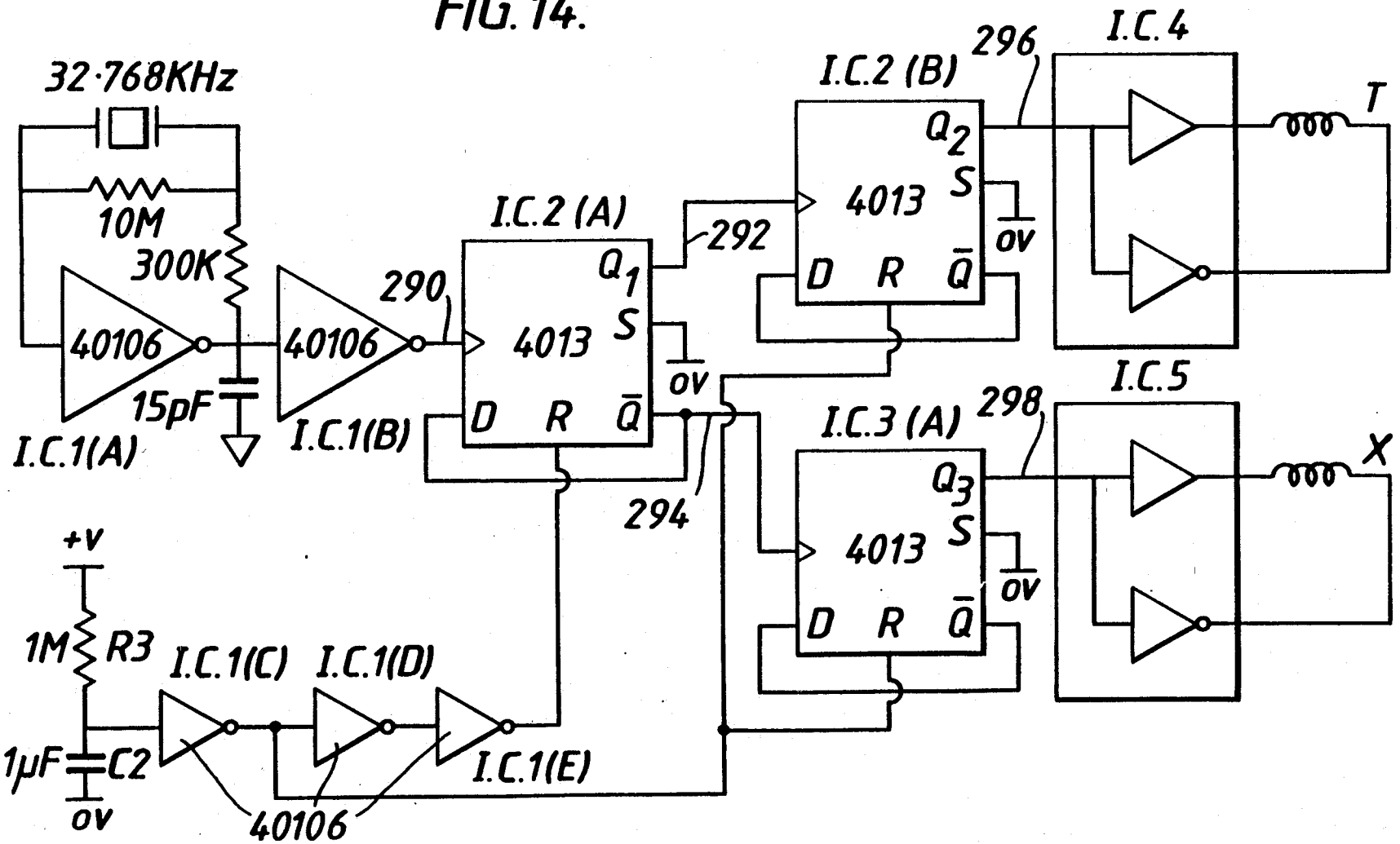
FIGS. 14, 15 and 16 show modified forms of circuit diagram of the radio sonde used in the mole.

FIG. 14 shows an improved version of FIG. 3. A 32.768 kHz cystal is used with a Schmitt inverter to generate a 32.768 kHz square wave at 290. The signal is divided using a "D" type flip-flop to give two antiphase signals at 16.384 kHz at 292 and 294. Each signal is then further divided using two more "D" type flip-flops to produce two quadrature signals at 8.192 kHz at 296 and 298. As the "D" type flip-flops are positive-edge triggered, the resulting outputs are 90° out of phase. The two signals are then buffered by IC 4 and 5 and used to drive the coils X and T.

IC 4 and IC 5 are power MOSFET devices used to drive the coils more efficiently than the transistors used in FIG. 3. A power-on reset circuit $R_3$, $C_2$, ICI (C,D,E) ensures that the signal driven into X leads the signal driven into T.

Figure 15:
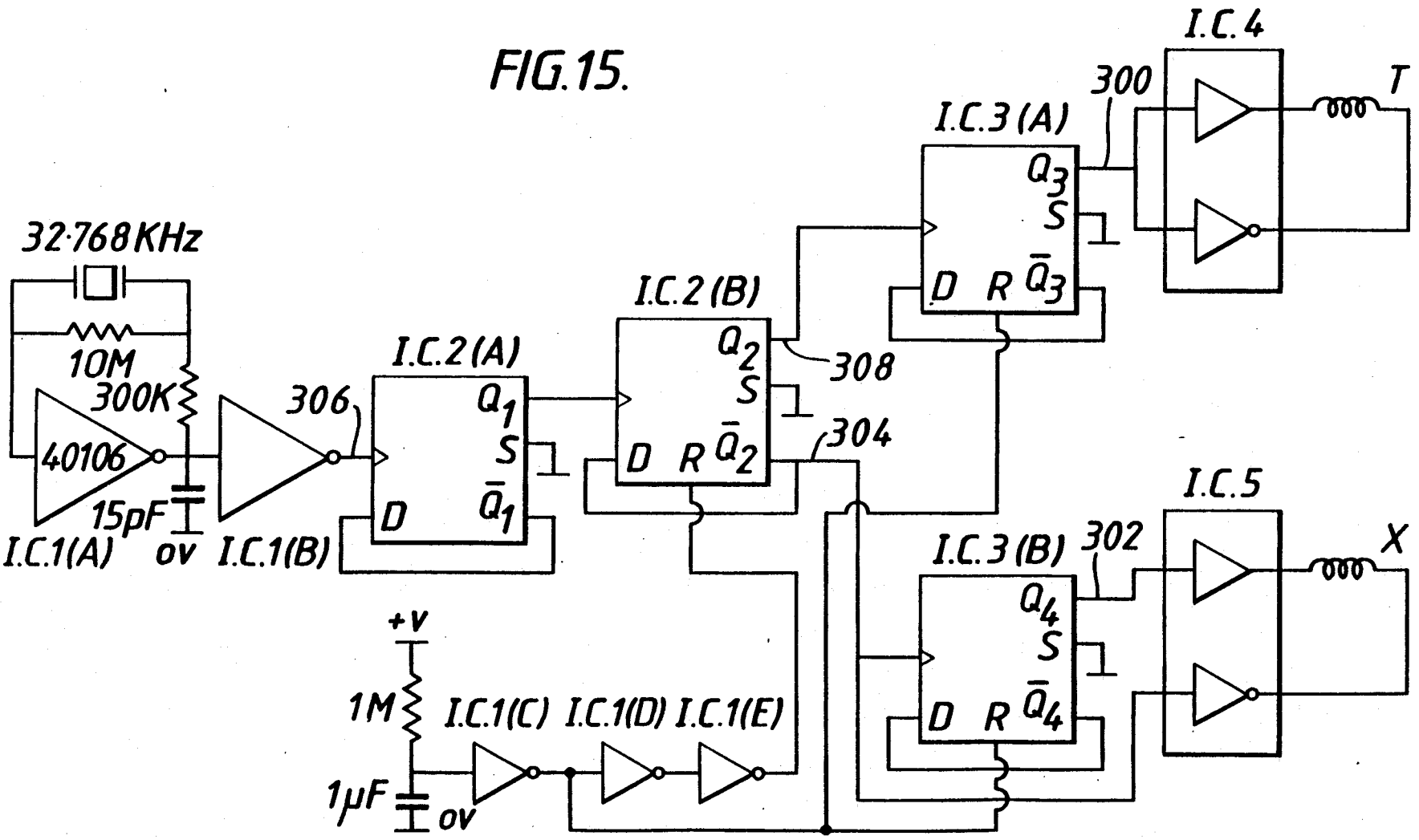

The coils (FIG. 15) are energised from an oscillator circuit which provides two 4 kHz square waves at 300 and 302 with a 90° phase shift between them and a third square wave at a higher frequency at 304. A 32.768 kHz crystal is used with a Schmitt inverter to generate a 32.768 kHz square wave at 306. The signal is divided using two cascaded "D" type flip-flops to give two antiphase signals at a frequency of 8.192 kHz at 308 and 304. The signal at 304 is buffered by one half of IC 5 and used to drive the coil X. The signals at 304 and 308 are then further divided using two more "D" type flip-flops to give two quadrature signals at 300 and 302 at a frequency of 4.096 kHz.

The signal is buffered by one half of IC 5 and used to drive coil X. The signal at 300 is buffered by IC 4 and used t drive coil T.

Figure 16:
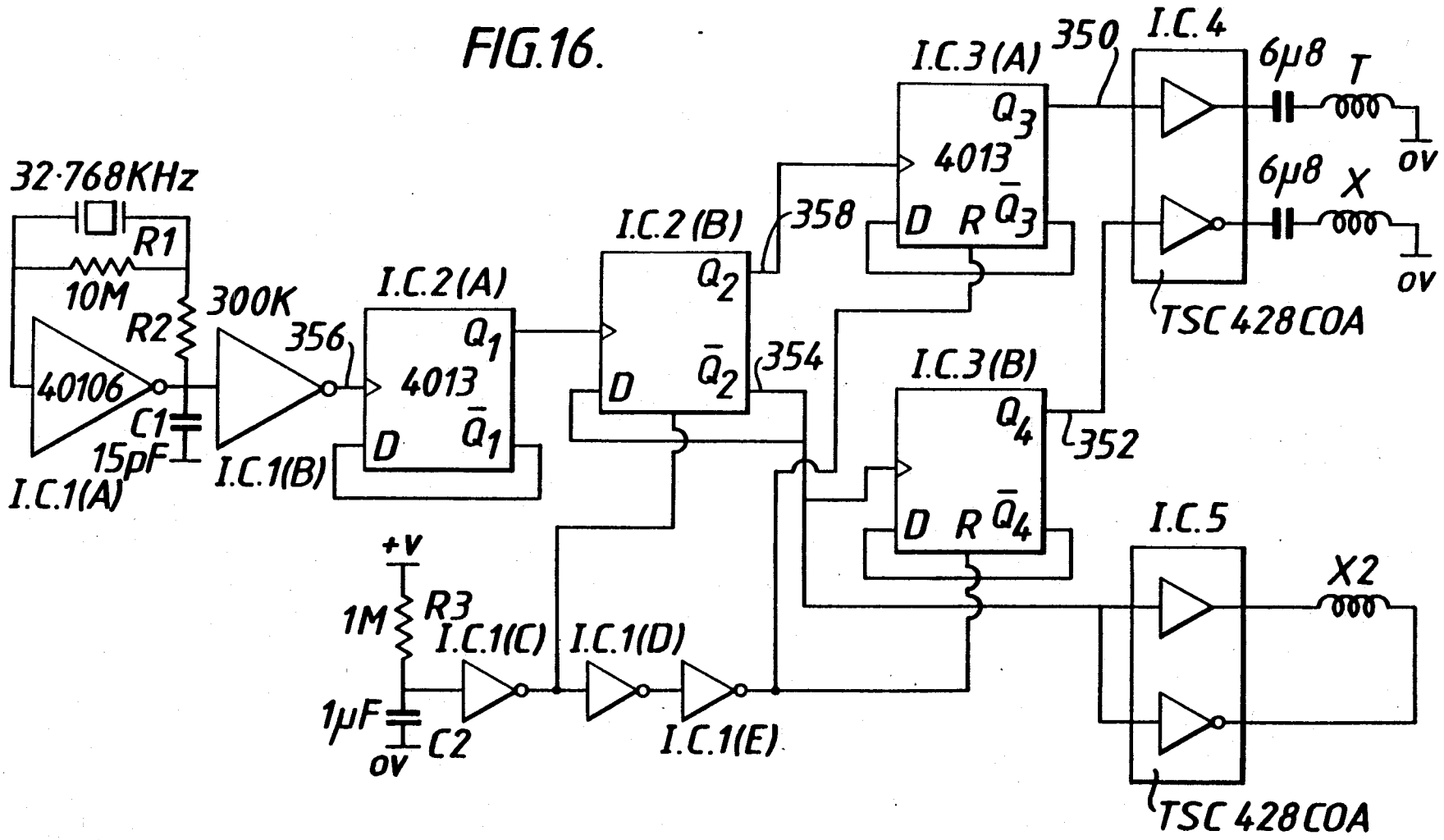

The coils (FIG. 16) are energised from an oscillator circuit which provides two square waves at 350 and 352 with a 90° phase shift between them and a third square wave at 354 at a higher frequency. A 32.768 kHz crystal is used with a Schmitt inverter to generate a 32.768 kHz square wave at 356. The signal is divided using two cascaded "D" type flip-flops to give two antiphase signals at a frequency of 8.192 kHz at 354 and 358. The signal at 354 is buffered by IC 5 and used to drive the coil $X_2$ (see FIG. 13). The signals at 354 and 358 are then further divided using two "D" type flip-flops to give at 350 and 352 two quadrature signals at a frequency of 4.096 kHz. These signals are then buffered by the IC 4 and used to drive the coils X,T.

A further method of extending the battery life is to use a remote activated switch in the radio sonde to switch off the power to the oscillator circuit and transmitter coils (FIG. 13).

In operation a transmitter unit 260 consisting of a sine wave oscillator 262 and a single transmit coil 264 is placed on the ground above the approximate location of the mole and aligned in the direction of the mole. The operator presses a button 266 to energise the oscillator and thus radiate the signal. The radiated signal is chosen to be of low frequency so that it may penetrate the steel head and be detected by one of the radio sonde coils, say X.

The signal is filtered and amplified and a phase lock loop is used to lock onto the signal and activate a logic circuit which switches on the power to the radio sonde oscillator circuit.

We claim:

1. A molding system which is capable of giving an indication of mole location and depth comprising a rotatable mole the roll angle of which is required to be known, a radio sonde in the mole having a first transmit coil lying parallel to the lengthwise direction of the mole and a second transmit coil lying transverse to said direction, means indicating a battery and an oscillator for energising the transmit coils with alternating current with a phase difference between the coils, a receiver traversable above ground into a position in which the receiver can give an indication of the roll angle of the mole, and display means, associated with said receiver and located above ground, for displaying said roll angle.

2. A system according to claim 1, wherein said mole includes a part which is magnetically actuated and which thus can interfere with the radiated magnetic field produced by said transmit coils the sonde being located in said magnetically active part of the mole.

3. A system according to claim 2, the sonde being located in a recess in a mole head of toughened steel, the dimensions of the recess being optimised to reduce interference with the radiated magnetic field so that roll angle can be measured to an accuracy of better than plus or minus 10° over a range of 350°.

4. A system according to claim 1, the mole being of 50 millimeters in diameter.

5. A system according to claim 1, wherein the first and second coils are energised by a single frequency, the energising voltages to the two coils having a phase difference between them and the radiated field from the coils being used for location and measurement of roll angle and depth.

6. A system according to claim 1, wherein the first and second coils are energised by a single frequency, the energising voltages to the two coils having a phase difference between them and the radiated field from the coils being used for roll angle measurement only, and the coil lying parallel to the lengthwise direction of the mole being additionally energised with a second frequency and the resulting radiated field being used for location and depth measurement.

7. A system according to claim 1, the radio sonde having a further transmit coil lying parallel to the lengthwise direction of the mole, the first transmit coil being energised by a first frequency and the resulting radiated field being used for location and depth measurement, and the further and the second transmit coils being energised by a second frequency, the energising voltage to the further and second coils having a phase difference between them and the resultant radiated field being used for roll angle measurement only.

8. A system according to claim 1, the receiver comprising a horizontal phase-reference receive coil and one other receive coil transverse to said phase-reference coil, which receiver is traversable above ground until said phase-reference receive coil is directly above the sonde and parallel to said first transmit coil, the receiver further comprising first means for measuring the variations of the amplitude of the signal from said other receive coil as the mole rotates, a second means for displaying the amplitude variations as an indication of roll angle, and a third means for detecting the phase reversal which occurs in the signal from the transverse receive coil as the mole rotates.

9. A system according to claim 1, the receiver comprising a horizontal phase-reference receive coil and two roll-angle receive coils transverse to each other and to said horizontal phase-reference receive coil, which receiver is traversable above ground until said phase-reference receive coil is directly above the sonde and parallel to said first transmit coil, a digital display on which roll-angle is displayed, a resolver/converter which receives outputs from all three coils, a fourth means for combining the output from the two roll angle receive coils, a fifth means for demodulating the combined signal using the signal from the horizontal phase-reference coil as a reference signal, and a sixth means of converting the demodulated signal into a digital signal for transfer to the display.

10. A system according to claim 1, the mole being impact driven.

11. A system according to claim 10, the sonde having an impact-activated switch which conserves battery power by switching off the sonde when measurements are not required by sensing the shock forces generated by the action of the impact driven mole then switching off the sonde while the mole is impacting, switching on when the mole stops impacting for a predetermined period during which measurements can be made and then automatically switching off again.

12. A system according to claim 1, the sonde being activatable in response to energisation of a radio transmitter at the ground surface.

13. A system according to claim 1, the same receiver being used to locate the position of the mole as viewed in plan and the depth of the mole.

* * * * *